United States Patent [19]

Griffin et al.

[11] 4,045,066

[45] Aug. 30, 1977

[54] BULK TOBACCO CONTAINER

[75] Inventors: J. Curtis Griffin; Clyde C. Griffin, both of Branford, Fla.

[73] Assignee: Harrington Manufacturing Company, Lewiston, N.C.

[21] Appl. No.: 699,671

[22] Filed: June 25, 1976

[51] Int. Cl.[2] ..... A24B 1/08

[52] U.S. Cl. ..... 294/5.5; 214/5.5

[58] Field of Search ..... 294/5.5; 34/236, 237, 34/238, 201; 56/27.5; 131/134, 140 R; 214/5.5; 432/500

[56] References Cited

U.S. PATENT DOCUMENTS

| | | | |
|---|---|---|---|
| 3,088,603 | 5/1963 | Boyette | 214/5.5 |
| 3,251,620 | 5/1966 | Hassler | 294/5.5 |
| 3,834,137 | 9/1974 | Long | 56/27.5 |
| 3,932,946 | 1/1976 | Johnson | 34/236 X |
| 3,935,959 | 2/1976 | Long | 294/5.5 X |
| 3,948,553 | 4/1976 | Suggs | 294/5.5 |

*Primary Examiner*—Johnny D. Cherry
*Attorney, Agent, or Firm*—Mills & Coats

[57] ABSTRACT

The present invention relates to an improved random leaf bulk tobacco container for supporting a mass of tobacco leaves therein during a curing and drying process. When oriented in an upright curing and drying position, the bulk tobacco container of the present invention basically comprises a pair of imperforated laterally spaced sides, a back retainer extending transversely between the laterally spaced sides, a front tine support frame also extending between the laterally spaced sides, and wherein the container is adapted to contain a mass of tobacco leaf material therein with the tobacco leaf material being supported by a plurality of tines extending between the front tine support frame and the back retainer of the bulk tobacco container. Provided about the back of the container is a perforated screen-like sheet member having openings formed therein for receiving the piercing ends of the tines and supporting the same. To lock the tines within the bulk tobacco container, the individual tines are angled about the end opposite the piercing end and once properly inserted through the front tine frame support and supported about the piercing end by the perforated screen-like member, the angled ends of the tines may be selectively rotated to where they extend between a locking bar and a transverse member of the front tine frame support, thereby locking the respective tines in place so as to generally prohibit movement of the tines from the normal supported position between the front tine frame support and the back of the container.

10 Claims, 6 Drawing Figures

BULK TOBACCO CONTAINER

The present invention relates to bulk tobacco support structures for holding and supporting field harvested tobacco, and more particularly to bulk tobacco support structures of the container or box type used in conjunction with curing and drying structures.

BACKGROUND OF THE INVENTION

Prior to 1974, bulk curing and drying systems included what is referred to as a small or single tier bulk tobacco rack such as shown and disclosed in U.S. Pat. No. 3,105,713 to F. J. Hassler. While the single tier rack was satisfactory and accepted commercially, it did, nevertheless, necessitate significant labor requirements to load each rack individually after the tobacco had been harvested.

Several years ago, Harrington Manufacturing Company of Lewiston, North Carolina, introduced a bulk tobacco curing and drying system that included what is now referred to as bulk tobacco containers or boxes which are adapted to receive field harvested tobacco and to support the same within a barn structure during the curing and drying process. Such a bulk tobacco container or box, as referred to above, is disclosed and shown in U.S. Pat. No. 3,948,553. One of the principal advantages in such a bulk tobacco container or box is that during the harvesting operation, tobacco leaves can be randomly filled directly into the container or box, after which the same container or box is placed directly in a curing and drying structure where the tobacco leaf material therein can be cured and dried. This, obviously, eliminates the retransfer of the tobacco leaves after harvesting as was required with the single tier rack disclosed in the Hassler Patent. Therefore, it can be generally stated that when such containers or boxes are used in conjunction with an automatic tobacco harvester, that substantially all of the hand handling of the tobacco leaves between harvesting and curing and drying is eliminated.

With containers or boxes it still remains important to uniformly load the tobacco therein, and to maintain the uniform distribution of the tobacco leaf material within the container during the entire curing and drying process. As shown in U.S. Pat. No. 3,948,553, referred to above, the containers or boxes are provided with a plurality of tines that extend through the mass of tobacco leaf material within the container, with the tines being supported about the front and back sides of the container when oriented in the curing and drying position. Therefore, it is appreciated that it is the tines that directly support the tobacco leaf material within the container or box.

In some bulk tobacco containers of the type being referred to, it has been found that the piercing ends of the tines sometime fail to locate a back support member for supporting the tines about the back of the container when disposed in the upright curing and drying position. This could be caused by a number of factors. Often as the respective tines are being inserted through the volume of tobacco leaf material they tend to skew at an angle and if the tines are not of sufficient length to reach the back support structure when skewed at such an angle the piercing ends of the tines fail to find support about the back of said container. In addition, if there is insufficient support structure about the back of the container, it then follows that in some cases the tines will not be able to locate a support structure for the piercing ends thereof.

In addition, in rotating the containers from a horizontal filling position to the upright curing and drying position the tines of some containers are proned to move or slide from the normal fully inserted position, causing the piercing ends of the tines to move away from the back support structure and thereby be unsupported. In either of the cases referred to above, the results are the same — the tobacco leaf material supported by the tines tends to slump, drop, and bunch in areas of the containers giving rise to nonuniform loading. In such cases, problems can be expected because the air during the curing and drying process will tend to pass through the vacated areas of the container, and the areas of high density do not receive sufficient quantities of air to completely dry the tobacco leaf material and consequently the quality of the cured leaf is less than desirable.

SUMMARY OF THE INVENTION

The present invention presents an improved bulk tobacco container or box of the type referred to above, and more particularly the bulk tobacco container or box of the present invention entails an improved design that virtually assures that each and every tine inserted through the mass of tobacco leaf material within said container will be supported about the back of said container, and further that once properly inserted and positioned within the container the respective tines may be locked in place. Such assures that the mass of tobacco within the container will be supported in generally uniform fashion throughout the container when the same is positioned in the upright curing and drying position, thereby avoiding problems presented when one or more tines fail to be supported about the piercing ends thereof and the tobacco is allowed to fall and slump into an area of the container.

More particularly in a preferred embodiment, to receive and support the piercing ends of the tines extending through the container, the back retaining means of the container is provided with a perforated screen-like member disposed adjacent a back frame, the perforated screen-like member having multiple openings over substantially the entire area thereof for receiving the piercing ends of said tines therethrough. Providing the container with said perforated screen-like member essentially makes the entire back area of said container, when disposed in the upright curing and drying position, a medium for supporting the tines. Consequently, if a tine is skewed or angled during the process of inserting the same through the mass of tobacco leaf material within the container, it follows that as long as the tine is of sufficient length, the piercing end thereof will reach and extend through some portion of the screen-like member and will be supported thereby.

In addition, the container is provided with a front tine support frame having tine openings formed therein which allow respective tines to be inserted therethrough one at a time and on through the mass of tobacco leaf material within said container. Associated with said tine support frame is means for locking the respective tines in place once they are properly inserted and positioned within the container. In this regard, the end of the tine opposite the piercing end or the end that lies adjacent the tine frame support means is particularly angled approximately 90 degrees to where that angle portion can be rotated to a locking area that is defined between a transverse support of the tine support frame and a back stop or locking bar secured in spaced apart relationship to the transverse member. Thus, by rotating the angled end of each of the tines into this locking position, it follows that the respective tines cannot then move outwardly from the container and particularly this cannot occur when the container or box is rotated approximately 90 degrees from its normal horizontal filling position to an upright curing and drying position.

It is, therefore, an object of the present invention to provide an improved bulk tobacco container or box that provides for improved tine support within the container or box and which virtually eliminates the possibility of tines not being fully supported about both end portions when the container or box is disposed in the upright curing and drying position during the curing and drying process.

Still a further object of the present invention resides in the provision of a random leaf bulk tobacco container having means for locking individual tines within said container once the tines have been properly inserted and positioned therein, thereby assuring that the tines will not move or slide outwardly from the container so as to cause the corresponding opposite piercing ends of the tines to fall short of back support means.

Another object of the present invention is to provide a bulk tobacco container with a back retaining means that includes a perforated screen-like member having multiple openings formed over substantially the entire area thereof so as to provide areas of support at virtually all areas and points about the back of said container.

A further object of the present invention resides in the provision of a bulk tobacco container having a generally loose or unattached single sheet perforated member that lies adjacent an open frame structure to form a strong and sturdy bottom for said container when disposed in a generally horizontal filling position and wherein said screen and frame form a back retaining and support means when said container is rotated to its upright curing and drying position.

Other objects and advantages of the present invention will become apparent from a study of the following description and the accompanying drawings which are merely illustrative of the present invention.

DESCRIPTION OF PREFERRED EMBODIMENT

Figure 3:
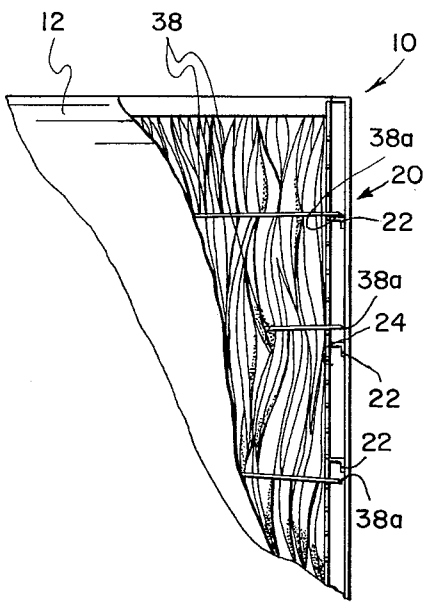
FIG. 3 is a fragmentary side elevational view of the bulk tobacco container of the present invention, with a portion of the side broken away to better illustrate the manner in which said perforated screen-like member supports said tines within said container.

With further reference to the drawings, the improved bulk tobacco container or box is shown therein and indicated generally by the numeral 10. Before dealing with a detailed discussion of the bulk tobacco container 10, as disclosed herein, it should be pointed out that such container is used in conjunction with a bulk tobacco curing barn or structure and that in use a plurality of such containers are appropriately disposed within the tobacco curing and drying barn with each container supporting a mass of tobacco leaf material therein for curing and drying. For a complete and thorough understanding of the basic structure of such a bulk tobacco container or box, one is referred to the disclosure of U.S. Pat. No. 3,948,553, the subject matter and contents thereof being expressly incorporated herein by reference.

Now turning to a discussion of the bulk tobacco container 10 shown in the present drawings, it is seen that the same comprises a pair of laterally spaced side retaining means in the form of a pair of imperforated sides 12 and 14. Each side 12 and 14 is supported about a rectangular frame, and when each respective container 10 is disposed within a curing and drying structure, the sides 12 and 14 principally function to restrict the vertically passing air to the container 10 and prohibit the same from moving outwardly from the side areas thereof. This assures that the air being forced through the curing and drying structure passes through the mass of tobacco leaf material contained within the container 10 and does not escape outwardly from the container prior to passing completely therethrough.

Provided about each side 12 and 14 of container 10 is a reinforcing strip 16 that has a stub axle 18 extending outwardly therefrom. Stub axle 18 is generally disposed in an off-center relationship about respective sides 12 and 14 of container 10 in order that the container may freely rotate approximately 90 degrees from a horizontal filling position to an upright curing and drying position in response to container 10 being lifted from the horizontal position about said stub axles 18.

Figure 2:
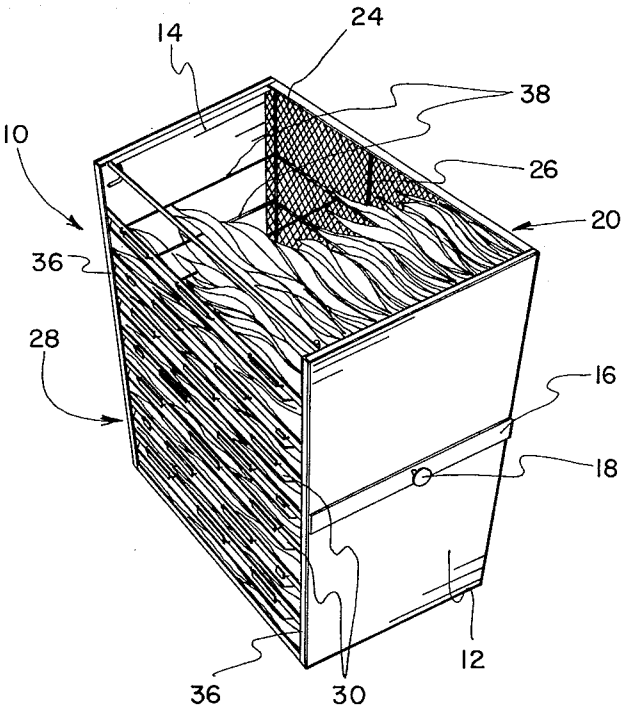
FIG. 2 is also a perspective view of the bulk tobacco container of the present invention, particularly illustrating the perforated screen-like member forming a part of the back of the container when so disposed.
Figure 1:
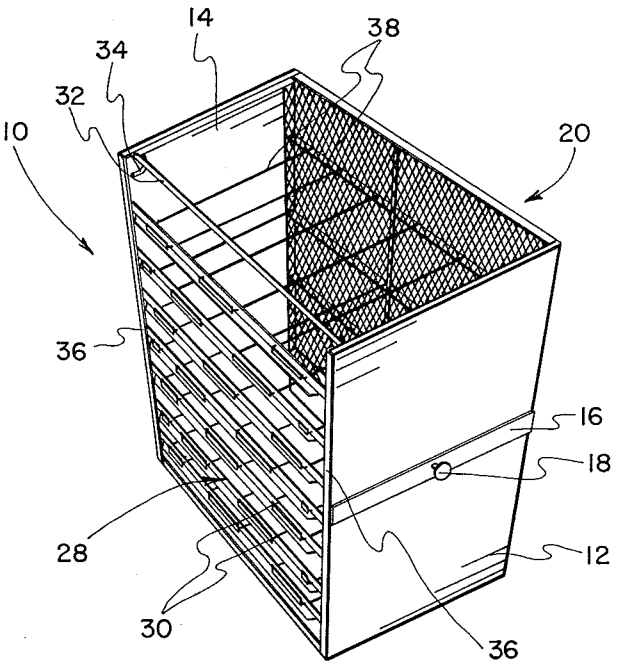
FIG. 1 is a perspective view of the improved bulk tobacco container of the present invention disposed in an upright curing and drying position.

Continuing to refer to the structure of bulk tobacco container 10, as shown in FIGS. 1 and 2, the same is provided with back retaining means, indicated generally by the numeral 20, that extend across the back side of the container 10 and between the laterally spaced imperforated sides 12 and 14. It should be pointed out that as a matter of reference the discussion herein describes the container 10 as the same would appear in the upright curing and drying position as particularly shown in FIGS. 1 and 2. With this in mind, and with further reference to back retaining means 20, it is seen that the same includes a back frame having a plurality of vertically spaced transverse support members 22 of a generally angle iron structure extending between the rear vertical edges of sides 12 and 14, as particularly shown in FIGS. 1 and 2. Disposed adjacent transverse support members 22 of the back frame is a perforated screen-like member 24 including multiple openings formed throughout the area thereof. Although various forms of perforated material may be used, it should be noted that expanded metal would function properly in accordance with the basic objects of the present invention.

Figure 6:
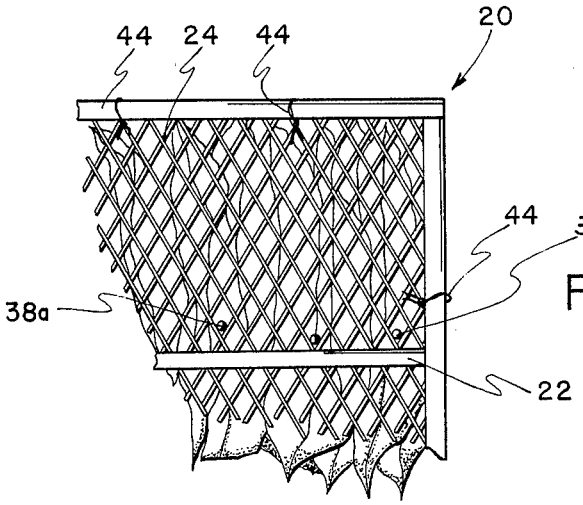
FIG. 6 is a fragmentary side elevational view of the container of the present invention as viewed from the back thereof when disposed in the upright curing and drying position, wherein said back portion includes a perforated screen-like member disposed adjacent a back frame and wherein said perforated screen is secured to said back frame by tied strands of wire in the particular embodiment depicted.

As viewed in the drawings, the perforated screen-like member 24 is in the form of a single sheet of material and is normally disposed directly adjacent the transverse support membes 22 of the back frame. While the same may not require actual securement to the back retaining means 20 or the back frame of the container 10, it is contemplated that the perforated screen-like member 24 could be secured directly to the back frame by any appropriate means, even by the use of wire ties 44 as illustrated in FIG. 6. Such ties 44 could be a segment of wire simply threaded through an appropriate opening within the perforated member 24 and wound around a portion of the back frame, after which the same can be twisted to form a means of securing the perforated screen-like member 24 to the back frame of the container 10.

Perforated screen-like member 24 can be structurally reinforced by a reinforcing rod 26 that extends substantially across the entire area of the screen, and as oriented in the drawings depicting the preferred embodiment of the present invention the screen is so disposed within the container 10 such that the reinforcing rod 26 extends generally perpendicular with respect to the transverse support members 22.

Completing the basic exterior structure of container 10 is a front tine support frame means, indicated generally by the numeral 28, that is movably mounted about the front side of the container 10, as viewed in the upright curing and drying positions shown in FIGS. 1 and 2. Referring to the tine support frame means 28 in more detail, it is seen that the same includes a plurality of transversely extending and vertically spaced transverse members 30, each of such members being of an angle iron type of construction. Extending along each side of the tine support frame means and having respective transverse members 30 secured thereto are a pair of side members 36 that extend vertically when the container is oriented as shown in FIGS. 1 and 2. Each side member 36 includes a locking finger 34 disposed on each end thereof wherein corresponding pairs of locking fingers are adapted to be retained by a transverse retaining bar 32 disposed about the top and bottom front portions of the container 10. As will be pointed out in subsequent portions of the disclosure, the tine support frame means 28 can be readily attached and detached from the container 10 when the same is in the horizontal filling position by selectively sliding the entire tine support frame means about the top of the container so as to latch or unlatch respective locking fingers 34 from one of the retaining bars 32.

With particular reference to the respective transverse members 30 of the tine support frame means, it is seen that each member includes a tine support bar or member **30*a* that includes a plurality of tine openings 30*b* laterally spaced along the tine support bar. Extending from the tine support bar 30*a* and integrally constructed therewith is an extension portion 30*c*, as particularly viewed in FIGS. 4 and 5**.

With bulk tobacco container 10 of the present invention, there is provided tine means in the form of a plurality of individual tines, each indicated by the numeral 38 and particularly adapted to be inserted through respective tine openings **30*b* formed in the tine support bars 30*a*. Each individual tine 38 includes a piercing end 38*a*, as seen in FIGS. 3 and 6, and an angled end 38*b*** that is turned at generally a right angle with respect to the major axis of the tine.

Figure 4:
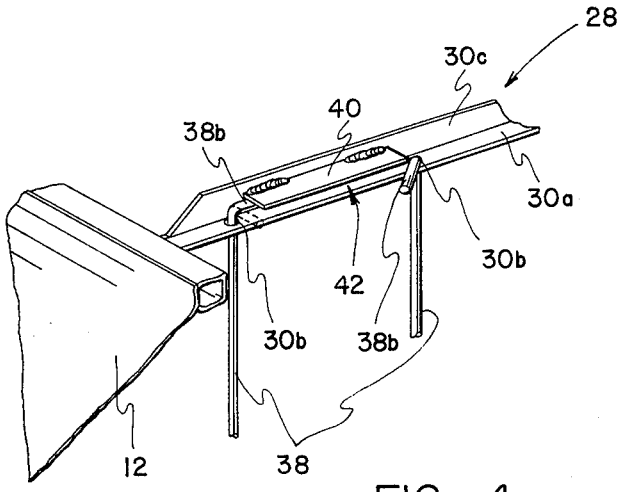
FIG. 4 is a fragmentary perspective view of a portion of the tine frame support means of said container and the tine locking means associated therewith.
Figure 5:
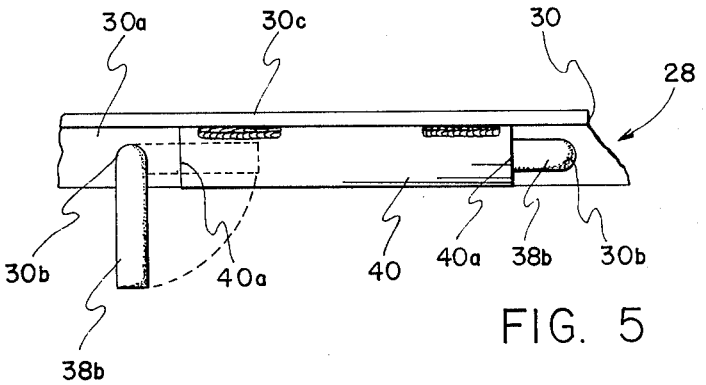
FIG. 5 is a fragmentary view of the tine frame support means of said container showing a locking bar associated therewith that permits each respective tine to be locked in place within said container.

Bulk tobacco container 10 of the present invention is provided with locking means associated with said tine support frame means to lock the individual tines 38 within the container 10 after the same are properly inserted and positioned within the container. Such locking means will assure that the individual tines 38 are not permitted to move outwardly from the tine support frame means 28 and away from the container while the same is filled with tobacco leaf material. Viewing the locking means just referred to in detail, it is seen in FIGS. 4 and 5 that each of the transverse members 30 of tine support frame means 28 is provided with a series of locking bars 40 that are secured to extension portion **30*c* and extend generally parallel with the tine support bars 30*a* of the respective transverse members 30. It is noted from FIGS. 4 and 5 that each locking bar 40 extends generally between successive pairs of tine openings 30*b* with the outer edge 40*a* terminating just inwardly of the respective tine openings 30*b*. This allows respective tines 38 to be inserted through openings 30*b* and unobstructed by the locking bars 40. But once respective tines 38 are completely inserted through openings 30*b* and the piercing ends 38*a* are supported by said perforated screen-like member 24 and/or respective transverse support members 22, the angled end 38*b* can be rotated approximately 90° , as illustrated in FIG. 5, to where the angled end assumes a position between the locking bar 40 and the tine support bar 30*a* that is referred to as a locking area 42**.

In operation, the container 10 is filled in a first horizontal filling position in which case the container is so oriented that the back retaining means indicated generally by the numeral 20 in FIGS. 1 and 2 is disposed in a horizontal position and in fact when so positioned becomes the bottom of the container. To fill, the tine support frame means 28 is removed and tobacco leaf material is generally distributed uniformly throughout the container 10 with the perforated screen 24 and the back frame serving to support the tobacco leaf material while the container is being filled. In the horizontal filling position, the tobacco leaves received are generally randomly aligned and lie in general horizontal planes, with the tobacco leaf material being disposed in overlying relationship from the bottom of the container (as oriented) to the top. Once the container is properly filled, the tine support means is appropriately secured about the top portion thereof by sliding the tine support frame means 28 in an appropriate manner whereby all of the locking fingers 34 may be retained and held about the container by the respective retaining bars 32.

After filling and properly positioning the tine support frame means 28, the individual tines 38 are inserted downwardly through openings **30*b*, through the mass of tobacco leaf material contained within the container 10 until the piercing ends 38*a* extend through the perforated screen 24 disposed above the back frame. It is appreciated that in inserting the tines, that they may skew or angle during the process, but because of the presence of the perforated screen 24 and the length of the tines 38, it is virtually assured that substantially all of the tines will penetrate through the plane of the perforated screen 24. After each tine is properly inserted and positioned within the container while the container is disposed in the horizontal filling position, the angled ends 38*b* of the tines are rotated to the locked position between respective locking bars 40** and tine support bars 30*a*. At this point, the entire container 10 may be lifted by the stub axles 18 which results in the respective container 10 being rotated approximately 90° from its horizontal filling position to an upright curing and drying position as shown in FIGS. 1 and 2. It will be appreciated that in the rotation of the container 10 the mass of tobacco leaves within the container after rotation will be supported primarily by the tines 38 and that during the rotation process that the mass of tobacco leaves will tend to urge the tines outwardly from the container away from the tine support frame means 28. But because the tines 38 are securedly locked about the tine frame support means 28, they cannot move outwardly from the container and the tines are thereby maintained in a relatively stationary position where they are supported about opposite ends by the back retaining means 20 (the screen 24 and/or transverse member 22) and the front tine support frame means 28.

From the foregoing specification, it is seen that the back retaining means and particularly the perforated screen-like member and back frame thereof in conjunction with said tine frame support means and the locking means associated therewith assures that virtually all of the tines are supported between front and rear portions of the container 10 and not allowed to be unsupported about the piercing ends 38*a* of the tines. Such assures that the uniform distribution of the tobacco leaves provided for in the filling of the container is maintained and the tobacco leaf material is supported within the container so that a quality cured and dried tobacco leaf product is possible.

The terms "upper", "lower", "forward", "rearward", "top", "bottom", etc., have been used herein merely for the convenience of the foregoing specification and in the appended Claims to describe the bulk tobacco container and its parts as oriented in the drawings. It is to be understood, however, that these terms are in no way limiting to the invention since the bulk tobacco container may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. In a bulk tobacco container of the type which when oriented in an upright curing and drying position includes laterally spaced side retaining means; back retaining means extending across the back of said container and extending between said laterally spaced side retaining means; front tine frame support means extending across the front of said container and between said laterally spaced side retaining means so as to define an area within said container for containing a mass of tobacco leaf material; open areas about both the top and bottom of said container for allowing air to move vertically through said container during the curing and drying process; and tine means extending from said front tine frame support means through said mass of tobacco towards said back retaining means for supporting the mass of tobacco leaf material within said container; the improvement comprising an improved back retaining means for said container for receiving and supporting portions of said tine means about the back of said container, said improved back retaining means as oriented in said upright curing and drying position including a back frame having a plurality of vertically spaced and transversely extending support members extending between said laterally spaced retaining side means; and a perforated screen-like member disposed directly adjacent said back frame and the transverse members thereof and extending substantially over the entire area of said back retaining means for receiving and supporting portions of said tine means that extend through the mass of tobacco leaf material about the back of said container.

2. The improved bulk tobacco container of claim 1 wherein said perforated screen-like member comprises a single sheet of expanded metal of an area not greater than the area of said back retaining means.

3. The improved bulk tobacco container of claim 2 wherein said expanded metal sheet includes a reinforcing rod-like member secured thereto and extending across said expanded metal sheet so as to generally reinforce and strengthen said expanded metal sheet.

4. The improved bulk tobacco container of claim 3 wherein said expanded metal sheet is disposed within said container such that said reinforcing rod-like member extends generally perpendicular to said transverse members of said back frame.

5. The improved bulk tobacco container of claim 2 wherein said improved back retaining means is provided with securing means for securing said perforated screen-like member directly to said back frame.

6. The improved bulk tobacco container of claim 1 wherein the improvement further includes tine locking means disposed on said tine frame support means for locking said tine means about said tine frame support means and prohibiting said tine means from moving outwardly from said tine frame support means and away from said container.

7. The improved bulk tobacco container of claim 6 wherein said locking means includes locking bar means disposed on respective transverse tine support members of said tine frame support means, said tine support members including a plurality of openings formed therein for receiving respective tines of said tine means, each tine including a locking end turned at generally a right angle relative to the longitudinal axis of said tines; and wherein said locking bar means is spaced outwardly from respective transverse tine support members so as to define a locking area between said locking bar means and respective transverse tine support members such that once a tine has been properly inserted and positioned within said container said locking end of a respective tine may be rotated to where the locking end lies within said locking area defined between said locking bar means and a respective transverse tine support member such that respective tines are securedly held within said container and will not be displaced therefrom in cases such as when said container is rotated from a filling position to said upright curing and drying position.

8. A bulk tobacco container, as oriented in an upright curing and drying position, comprising: a pair of laterally spaced side retaining means; back retaining means extending across the back of said container and including a perforated screen-like member, having openings formed therein, that form a part of the back of said container; a front tine frame support means normally disposed across the front of said container and extending generally between said laterally spaced side retaining means and in spaced apart relationship relative to said back retaining means and said perforated screen-like member forming a part thereof; tine means including a plurality of tines each supported about a first end portion by said tine frame support means and extending therefrom towards said back retaining means where a second end portion thereof extends through openings formed in said perforated screen-like member and wherein each of said tines is supported about said second end portion opposite said tine frame means by said perforated screen-like member; and tine locking means disposed about said tine frame support means for locking said first end of each of said tines of said tine means and holding the same in a secured and locked position within said container such that when said container is filled said tines extend through a mass of tobacco leaf material within said container and are only supported about front and back sides of said container.

9. The bulk tobacco container of claim 8 wherein said back retaining means includes a back frame disposed adjacent said perforated screen-like member, and wherein said back frame includes a plurality of vertically spaced transversed members that together with said perforated screen-like member form the back of said container and wherein said perforated screen-like member and said back transverse members function together to receive and support the second end portions of said tines.

10. The bulk tobacco container of claim 9 wherein said tine frame support means includes a plurality of laterally spaced transverse members with each member including a tine support bar having a plurality of laterally spaced openings formed therein for receiving respective tines therethrough; and wherein said locking means comprises locking bar means formed about each of said transverse members and spaced outwardly from each of said tine support bars thereof such that an angled end portion of respective tines may be rotated to where the same is positioned between said tine support bar and a respective locking bar means whereby when so positioned respective tines are prohibited from moving outwardly from said container.

* * * * *